US007371189B2

(12) United States Patent
Yamamoto

(10) Patent No.: US 7,371,189 B2
(45) Date of Patent: May 13, 2008

(54) IRON GOLF-CLUB HEAD AND AN IRON GOLF CLUB INCLUDING THE SAME

(75) Inventor: Akio Yamamoto, Kobe (JP)

(73) Assignee: SRI Sports Limited, Kobe (JP)

( * ) Notice: Subject to any disclaimer, the term of this patent is extended or adjusted under 35 U.S.C. 154(b) by 281 days.

(21) Appl. No.: 11/060,787

(22) Filed: Feb. 18, 2005

(65) Prior Publication Data

US 2005/0209018 A1 Sep. 22, 2005

(30) Foreign Application Priority Data

Mar. 19, 2004 (JP) ..... 2004-079834

(51) Int. Cl.
*A63B 53/04* (2006.01)

(52) U.S. Cl. ..... 473/330; 473/342

(58) Field of Classification Search ..... 472/324–350
See application file for complete search history.

(56) References Cited

U.S. PATENT DOCUMENTS 5,209,473 A * 5/1993 Fisher ..... 473/291
5,976,029 A * 11/1999 Sherwood ..... 473/291

FOREIGN PATENT DOCUMENTS

JP 2000-116828 A 4/2000

* cited by examiner

*Primary Examiner*—Alvin A Hunter, Jr.
(74) *Attorney, Agent, or Firm*—Birch, Stewart, Koalsch & Birch, LLP

(57) ABSTRACT

A configuration of an iron golf-club head is defined as follows in order to offer ease of addressing a ball with face open. In a projected figure of the head focused on a projection plane including a sweet spot and normal to a perpendicular from a center of gravity of the head to a face thereof, a maximum transversal is defined by a straight line cutting across a face contour over the greatest length as passing through an intersection of a leading edge and a straight line drawn from a heel-side end point of a face line in a predetermined direction of the projected figure, and forms an angle of 39° to 50° (inclusive) relative to a horizontal line. The face contour has a radius of curvature of 10 mm to 22 mm (inclusive) in the vicinity of a toe-side intersection of the face contour and the maximum transversal.

4 Claims, 5 Drawing Sheets

IRON GOLF-CLUB HEAD AND AN IRON GOLF CLUB INCLUDING THE SAME

FIELD OF THE INVENTION

The present invention relates to an iron club head offering ease of addressing a ball with a face open, and an iron golf club including the same.

DESCRIPTION OF THE PRIOR ART

Iron golf clubs having a loft angle of at least 45°, including wedge clubs such as sand wedges (SW), approach wedges (AW) and pitching wedges (PW), are used for hitting approach shots, banker shots and so on under various conditions. Therefore, the iron golf clubs need be adapted to hit any of various shots selectively. This leads to a strong demand for a club which itself has a performance to allow a player to hit selectively any of the various shots of different flight trajectory heights or spin rates by hitting the ball with the face square or with the face open, or by properly adjusting the open angle of the face when hitting the ball. As the open angle of the face is increased, the face provides the greater effective loft (impact loft) upon impact on the ball. Furthermore, a swing with the increased open angle of the face is more likely to move the club head along an outside-in path. Therefore, the player is allowed to hit selectively any of the various shots of different flight trajectory heights or spin rates by controlling the open angle of the face.

However, in a case where a head shape appears incongruous to the player assuming an address posture with the face open, such a sense of incongruity may affect his swing, leading to a higher probability of miss hit or misdirected ball flight trajectory. In this connection, Japanese Unexamined Patent Publication No. 2000-116828 proposes a wedge club head which is designed to have such a head configuration as to offer ease of addressing the ball with the face open, the configuration wherein a top line and a leading edge each have an arcuate shape having a predetermined radius.

OBJECT AND SUMMARY OF THE INVENTION

However, it is found that even the club head stated in the aforementioned patent document may be improved further because the club head does not necessarily offer an adequate ease of addressing the ball with the face open. Specifically, the club head according the above patent document has a relatively great radius of curvature at an upper side of a toe area, so that the face has a relatively short length between a lower side of a heel area and the upper side of the toe area. Accordingly, a ball path on the face (a length over which the ball cuts across the face as seen from a player side) is decreased when the player hits the ball with the face open. This leads to difficulty of imaging the path of the ball and thence, to difficulty of clearly imaging a swing path. Such difficulties adversely affect the player's golf swing.

Furthermore, the head has an excessively great radius of curvature at the leading edge thereof (that is, the leading edge is less rounded or rather linearly shaped), so that the player recognizes the orientation of the face (the direction of the normal of the face) too clearly. Accordingly, the (right-handed) player assuming the address posture with the face open becomes so anxious about the ball flying further rightward than intended, or about making an unsuccessful impact on the ball. Thus, the anxiety may adversely affect the player's swing.

In view of the foregoing, the invention has an object to provide an iron golf-club head offering ease of addressing the ball with the face open, and an iron golf club including the same.

According to the invention, an iron golf-club head has a loft angle of 45° or more; and has a face line inclined at an angle of 2° or less relative to a horizontal direction as determined in a reference position where the head is placed on a horizontal plane at a predetermined lie angle and a predetermined loft angle; and is characterized in that a maximum transversal is defined by a straight line cutting across a face contour over the greatest length as passing through an intersection of a leading edge and a straight line drawn from a heel-side end point of the face line in a predetermined direction in a projected figure of the head focused on a projection plane which includes a sweet spot and is normal to a perpendicular from a center of gravity of the head to a face, and forms an angle of 39° or more to 50° or less with an intersection defined by the projection plane and the horizontal plane in the reference position; and that the face contour has a radius of curvature of 10 mm or more to 22 mm or less in the vicinity of a toe-side intersection of the face contour and the maximum transversal.

As configured in this manner, the iron golf-club head having the loft angle of at least 45° and including the substantially horizontally extended face line as seen in the aforesaid reference position offers ease of addressing a ball with the face open. The iron golf-club head is typically exemplified by a so-called wedge club. Specifically, the maximum transversal forms the angle of 39° to 50° (inclusive) with the intersection defined by the projection plane and the horizontal plane in the reference position, whereas the face contour has a radius of curvature of 10 mm to 22 mm (inclusive) in the vicinity of the toe-side intersection of the face contour and the maximum transversal. Therefore, the head may have a relatively great length of the maximum transversal on the face, thus attaining a head shape appearing less incongruous to the player addressing the ball with the face open.

According to the aforementioned golf-club head, it is preferred that the leading edge has a radius of curvature of 110 mm to 140 mm (inclusive), as determined in the projected figure. In this case, the likelihood of the player less clearly recognizing the orientation of the face when addressing the ball with the face square is reduced because the leading edge has the radius of curvature of 110 mm or more. In addition, since the curvature radius of the leading edge is 140 mm or less, the player addressing the ball with the face open is more likely to have feeling of making a successful impact on the ball.

DESCRIPTION OF THE PREFERRED EMBODIMENTS

The preferred embodiments of the invention will hereinbelow be described with reference to the accompanying drawings.

Figure 1:
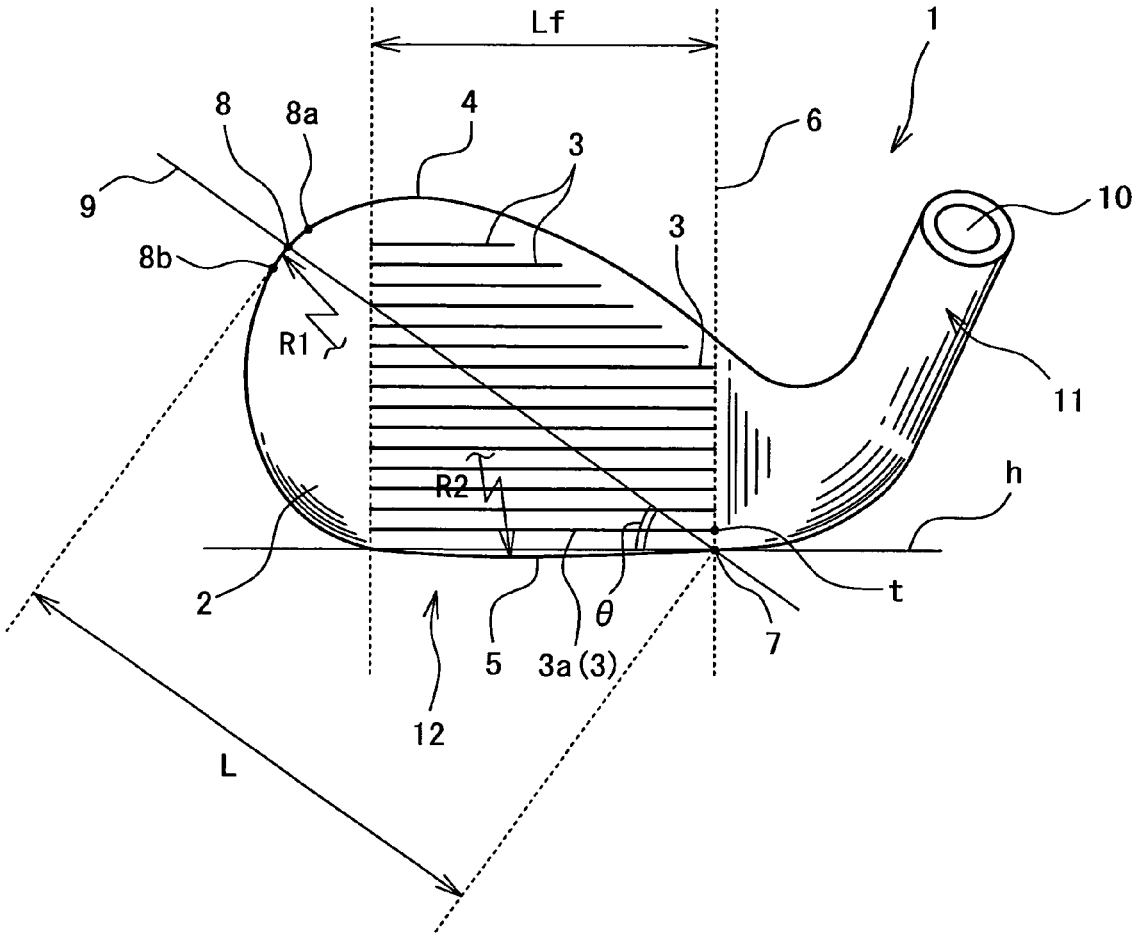
FIG. 1 is a projected plan showing an iron golf-club head according to one embodiment of the invention.

FIG. 1 shows a projected figure (hereinafter, simply referred to as "projection") of an iron golf-club head 1 (hereinafter, simply referred to as "iron head" or "head") according to one embodiment of the invention, the figure focused on a projection plane. The projection plane means a plane which includes a sweet spot (not shown) and is normal to a perpendicular from a center of gravity (not shown) of the head 1 to a face 2. It is noted that a toe curvature radius R1, a leading-edge curvature radius R2 and a maximum transversal angle θ are measured on the aforesaid projection. The curvature radii R1, R2 and the angle θ are measured on the projection in consideration of a case where the face 2 is not a flat surface. However, in a case where the face 2 is the flat surface like that of the common iron golf-club head, the curvature radii R1 and R2 and the angle θ as measured on the face 2 are of the same values as those of the curvature radii R1 and R2 and the angle θ measured on the projection.

The iron head 1 includes: the face 2 contacting a ball upon impact; a hosel 11 formed with a hosel top socket 10 for receiving a shaft (not shown) which is bonded thereto; and a sole 12 defining a bottom of the head 1. The face 2 is a flat surface. The iron head 1 has a loft angle (real loft angle) of at least 45°, which corresponds to that of so-called wedges such as a pitching wedge (PW), an approach wedge (AP) and a sand wedge (SW).

The face 2 is formed with a plurality of face lines 3 including the lowermost face line 3*a* closest to the sole. The individual face lines are extended substantially straight and in parallel to each other. All the face lines 3 are designed to be angled at 2° or less relative to a horizontal line h which is a straight line parallel to an intersection defined by the projection plane and a horizontal plane in a reference position where the head 1 is placed on the horizontal plane at a predetermined lie angle and at a predetermined loft angle. That is, all the face lines 3 are designed to extend substantially in parallel with the horizontal direction in the reference position.

A detailed description is made on the face 2. The face 2 is defined by a curved or flat surface, which has a radius of curvature of at least 500 mm (a radius of the greater curvature of principal curvatures). A circumferential edge of the curved or flat surface forms an end of the face 2, thus defining a face contour 4. In other words, the face contour 4, as a boundary between the face 2 and a portion other than the face 2, is defined by a boundary between a portion forming the curved or flat surface having the curvature radius of at least 500 mm and a portion not forming the curved or flat surface having the radius of curvature of at least 500 mm. Thus, a portion enclosed by the face contour 4 defines the face 2. Out of the face contour 4, a portion extended along the sole 12 defines a leading edge 5. In the iron golf-club head, the face 2 is normally constituted by a plane. In this case, therefore, a circumferential edge of the plane (a boundary between the plane and a non-planar surface) defines the end of the face 2 or the face contour 4. In the drawings of the head such as FIG. 1, only a portion of the face contour 4 which substantially coincides with a contour of the iron head 1 is depicted while a portion of the face contour 4 which exists between the face 2 and the hosel 11 is omitted. Except for the aforementioned portion not shown, the face contour 4 is constituted by a smooth, continuous curved ridge projected outwardly from the face 2.

The maximum transversal 9 is defined by a straight line cutting across the face contour 4 over the greatest length as passing through a heel-side intersection 7 which is an intersection of the leading edge 5 and a straight line 6 drawn from a heel-side end point t of the face line 3 in a predetermined direction of the projection. That is, the maximum transversal 9 is the longest one of straight lines passing through the heel-side intersection 7 or the line having the greatest length L (i.e., the length L on the face 2) between a toe-side intersection 8 with the face contour 4 and the heel-side intersection 7, as seen on the projection.

In a case where the plural face lines 3 include those having heel-side end points located at different positions, the heel-side end point t is defined by one of face-line end points that is located closest to the heel side.

The perpendicular direction of the projection is defined as follows. In the reference position where the head 1 is placed on the horizontal plane at the predetermined lie angle and at the predetermined loft angle, a set plane is defined which passes through a predetermined point on the face 2 (the sweet spot, for instance) as perpendicularly intersecting the face 2 at the predetermined point, and which also perpendicularly intersects the horizontal plane. Provided that a line where the set plane thus defined intersects the face 2 is defined as a set line (not shown), a direction of the set line as focused on the projection plane is defined as the perpendicular direction of the projection. In FIG. 1 and in the other embodiments, a line interconnecting the individual heel-side end points of the longest ones 3 of the plural face lines 3 coincides with the straight line 6 drawn from the heel-side end point t along the perpendicular direction of the projection.

The angle θ of the maximum transversal formed between the horizontal line h and the maximum transversal 9 as seen in the projection (see FIG. 1) is defined to range from 39° to 50° (inclusive), whereas a toe curvature radius R1 is defined to range from 10 mm to 22 mm (inclusive). The toe curvature radius R1 is a radius of a curvature of the face contour in the vicinity of the toe-side intersection 8 of the face contour 4 and the maximum transversal 9. Such a design provides a relatively great length L of the maximum transversal 9 on the face 2. The reason is as follows. If the above length L is to be increased on condition that the length of the face 2 with respect to a toe-heel direction is fixed at a predetermined value, it is more advantageous to define the toe curvature radius R1 of the face contour 4 in a manner to set the angle θ to the predetermined value described above, thereby allowing the maximum transversal 9 to cut across the face 2 substantially diagonally. In the iron head having a loft angle of at least 45°, the above face length is normally in the range of 65 mm to 85 mm (inclusive).

Where the length L of the maximum transversal 9 on the face 2 is increased, the length of a ball path on the face 2 is increased when the ball is hit with the face open. This offers ease of imaging the ball path, thus allowing the player to have a clear image of a swing path. This leads to an enhanced ease of accomplishing an intended swing. Accordingly, it becomes easier to control the height of a flight trajectory or the spin rate as desired and hence, the player may achieve high scores. Thus, the head is so configured as to provide less awkward feeling when the player addresses the ball with the face open.

That is, the greater the length L, the more preferred is the head. The length L may preferably be at least 80 mm, and more preferably at least 83 mm. However, the size of the face 2 is limited. Furthermore, if the length L is increased too much, the toe curvature radius R1 is decreased excessively, so that the configuration of the head may appear incongruous. Therefore, the length L may preferably be up to 90 mm, and more preferably up to 88 mm.

According to the conventional iron golf-club head having the loft angle of at least 45°, a set of iron golf clubs including the iron heads having the loft angle of at least 45° (such as an iron golf-club set including a long iron, a middle iron, a short iron and such, the club set referred to simply as "set" hereinafter) places importance on balanced shape variations or smooth shape variations of sequentially numbered iron clubs. An iron head having a loft angle of less than 45° is rarely used with the face open, whereas the iron head having the loft angle of at least 45° is often used with the face open. The iron heads simply focusing the importance on the balanced shape variations or the smooth shape variations of the sequentially numbered clubs of the set do not necessarily make iron heads easy to address with the face open.

The toe curvature radius R1 is determined as follows. In the projection shown in FIG. 1, the toe curvature radius R1 is defined by a radius of a curvature of an arc passing through three points in total, which include the toe-side intersection 8 and two opposite points 8*a*, 8*b* with respect to the toe-side intersection 8. The opposite points 8*a*, 8*b* are on the face contour 4 and are each 5 mm (based on distance measured along the face contour 4) away from the toe-side intersection 8.

In the aforementioned projection, the leading edge 5 is constituted by a curved ridge projected outwardly from the face 2. The leading edge has a radius of curvature R2 of 110 mm to 140 mm (inclusive).

Figure 3:
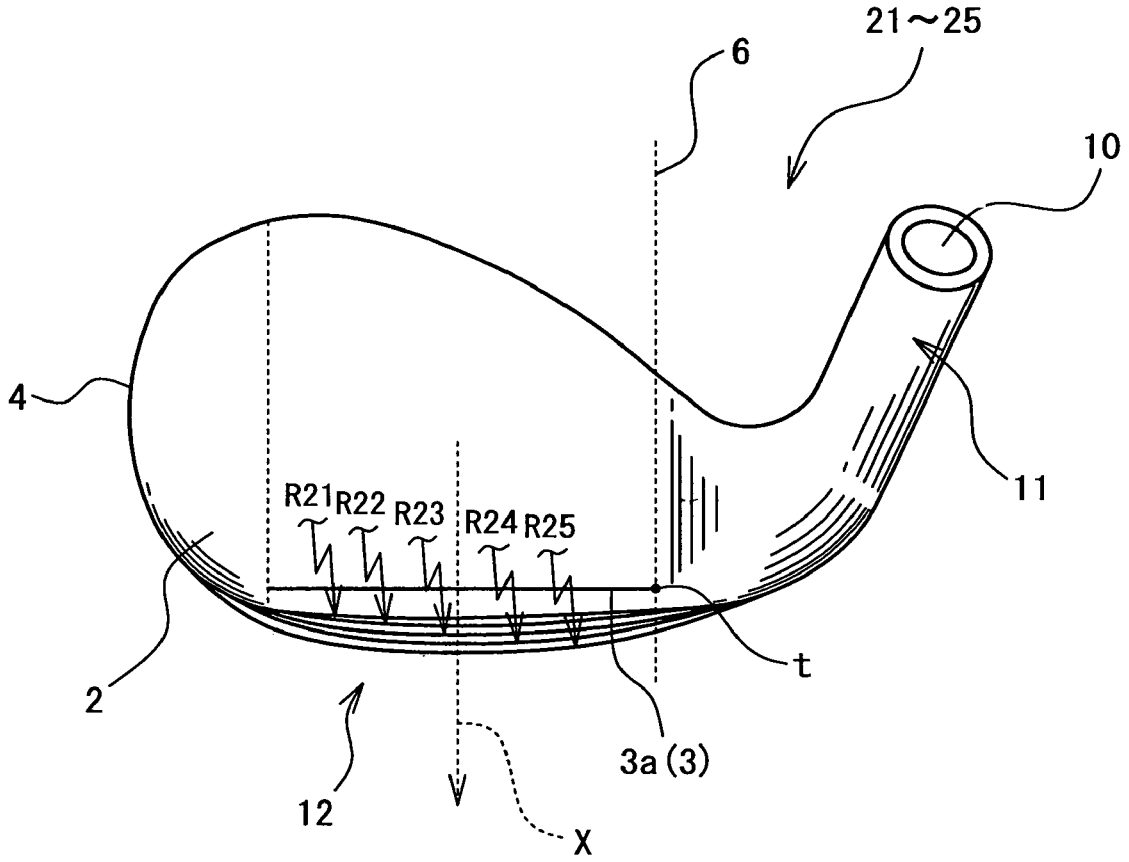
FIG. 3 shows projected plans of five types of iron golf-club heads in overlapped relation, the heads each having a different shape at a leading edge.

Now, description is made on a relation between the curvature radius R2 of the leading edge 5 and the degree of ease of assuming a posture to address the ball with the face open (ease of address). FIG. 3 shows projected plans of five types of heads 21 to 25 in overlapped relation, the heads each having a different curvature radius at the leading edge. A curvature radius R2 of the leading edge 5 of the head 21 is represented by R21; a curvature radius R2 of the leading edge 5 of the head 22 is represented by R22; a curvature radius R2 of the leading edge 5 of the head 23 is represented by R23; a curvature radius R2 of the leading edge 5 of the head 24 is represented by R24; and a curvature radius R2 of the leading edge 5 of the head 25 is represented by R25. The curvature radii of the heads 21 to 25 have a numerical relation of R21>R22>R23>R24>R25.

As shown in FIG. 3, as the curvature radius of the leading edge 5 decreases, the degree of roundness (the degree of the protrusion) of the leading edge 5 increases. As the roundness of the leading edge 5 increases, the orientation X of the face (the normal direction of the face 2, as represented by a broken line in FIG. 3) is less clearly recognized. This is because during address, the player tends to recognize a direction perpendicular to the leading edge 5 as the orientation of the face. As the leading edge 5 is more linearly shaped, it becomes easier to recognize the direction perpendicular to the leading edge 5. The leading edge 5 having a smaller radius of curvature R2 is increased in the degree of roundness so that the orientation X of the face is less clearly recognized. Conversely, the leading edge 5 having a greater radius of curvature R2 is decreased in the degree of roundness (more linearly shaped) so that the orientation X of the face is more clearly recognized.

Since the embodiment defines the radius of curvature R2 to be 110 mm or more, there may be obviated a condition where the player addressing the ball with the face square has difficulty in recognizing the orientation X of the face which has an excessively small radius of curvature at the leading edge (an excessive roundness at the leading edge 5). Thus, the player is allowed to direct the face 2 to a target direction more easily. For the same reason, it is more preferred to define the curvature radius R2 of the leading edge 5 to be at least 115 mm.

Since the embodiment defines the radius of curvature R2 to be 140 mm or less, the player addressing the ball with the face open is more likely to have an image of making a successful impact on the ball. The head having an excessive curvature radius R2 at the leading edge (the leading edge 5 having an excessively small roundness) involves the following problem. That is, the player may recognize the orientation X of the face too clearly. Hence, the (right-handed) player addressing the ball with the face open may become so anxious about the ball flying further rightward than intended, or about making an unsuccessful impact on the ball. The anxiety may adversely affect the player's swing. In contrast, the inventive head, having the curvature radius R2 of 140 mm or less, minimizes the anxiety of making the unsuccessful impact on the ball so that the player at address is allowed to have the image of making the successful impact on the ball. Accordingly, the player is more likely to make an intended swing, thus achieving high scores. It is therefore preferred to define the curvature radius R2 to be 130 mm or less, more preferably 125 mm or less, and particularly preferably 120 mm or less.

Figure 4:
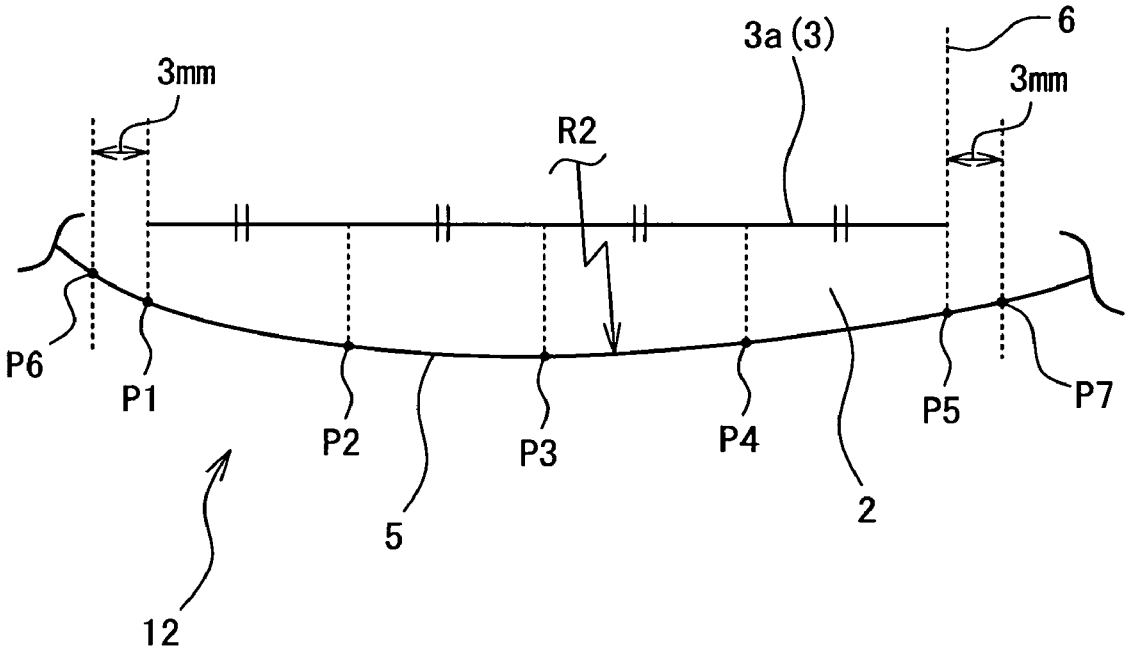
FIG. 4 is a diagram for explaining a method of calculating a radius of curvature of the leading edge.

The curvature radius R2 of the leading edge 5 may be determined as follows. As shown in FIG. 4, the lowermost face line 3*a* as seen in the projection is divided into four equal parts. Draw a line from each of five points in the perpendicular direction of the projection, the five points including the division points and the opposite end points of the lowermost face line 3*a*. Respective intersections of the straight lines thus drawn and the leading edge 5 are represented by P1, P2, P3, P4 and P5 in the order named from the toe-side intersection. Provided that RA represents a curvature radius (mm) of an arc passing through the three points P1, P2 and P3; RB represents a curvature radius (mm) of an arc passing through the three points P2, P3 and P4; and RC represents a curvature radius (mm) of an arc passing through the three points P3, P4 and P5, a value of (RA+RB+RC)/3 may be defined as the curvature radius R2 of the leading edge 5.

According to the invention, it is preferred to define the value of the curvature radius R2 to range from 110 mm to 140 mm. However, the following definition is more preferred. Provided that an intersection of the leading edge 5 and a straight line drawn in the predetermined direction in the projection plane from a point 3 mm shifted from the point P1 toward the toe side as seen in the projection is represented by P6, and that an intersection of the leading edge 5 and a perpendicular line from a point 3 mm shifted from the point P5 toward the heel side as seen in the projection is represented by P7, a curvature radius z (not shown) of an arc passing through any three of the points on the leading edge 5 between P6 and P7 is preferably defined to be at least 100 mm, or more preferably at least 110 mm. The reason is the same as that for preferably defining the curvature radius R2 of the leading edge 5 to be at least 110 mm. In addition, it is preferred to define the curvature radius z to be 200 mm or less, and more preferably 140 mm or less. The reason is the same as that for preferably defining the curvature radius R2 of the leading edge 5 to be 140 mm or less.

Figure 2:
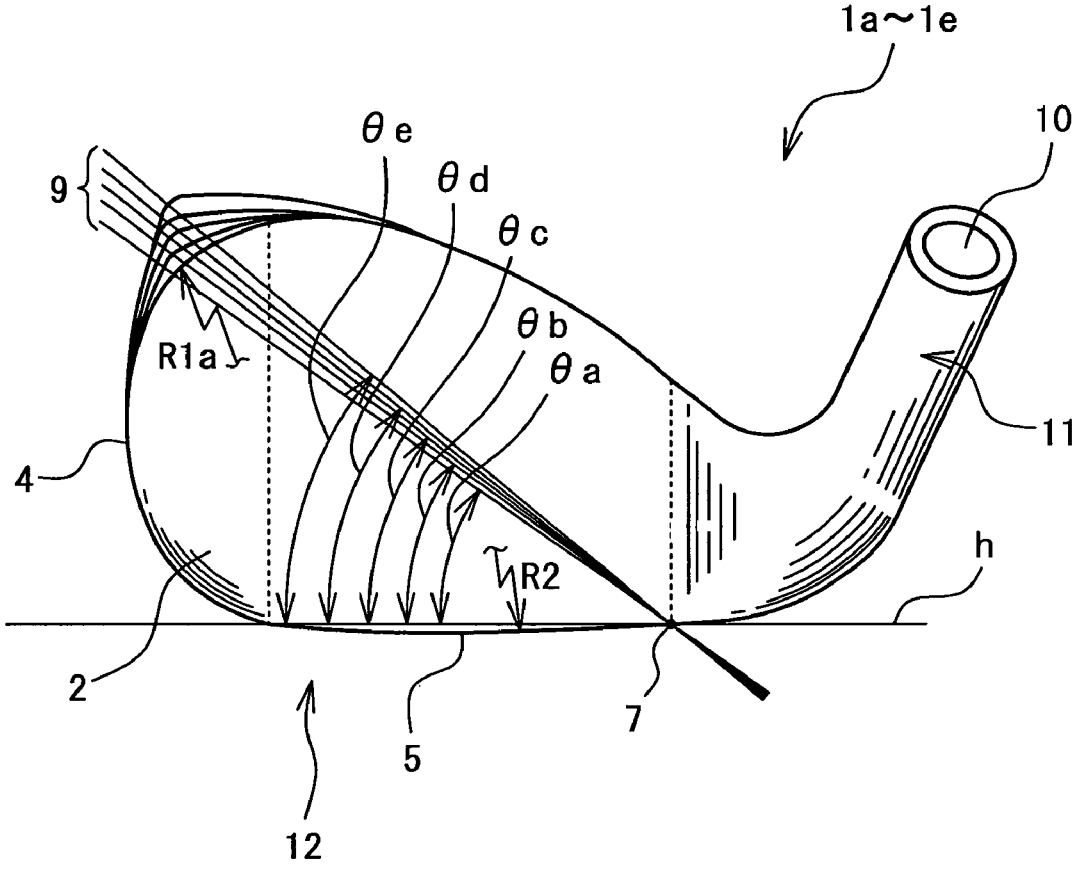
FIG. 2 shows projected plans of five types of iron golf-club heads in overlapped relation, the heads each having a different shape at an upper part of a toe area.
Figure 5:
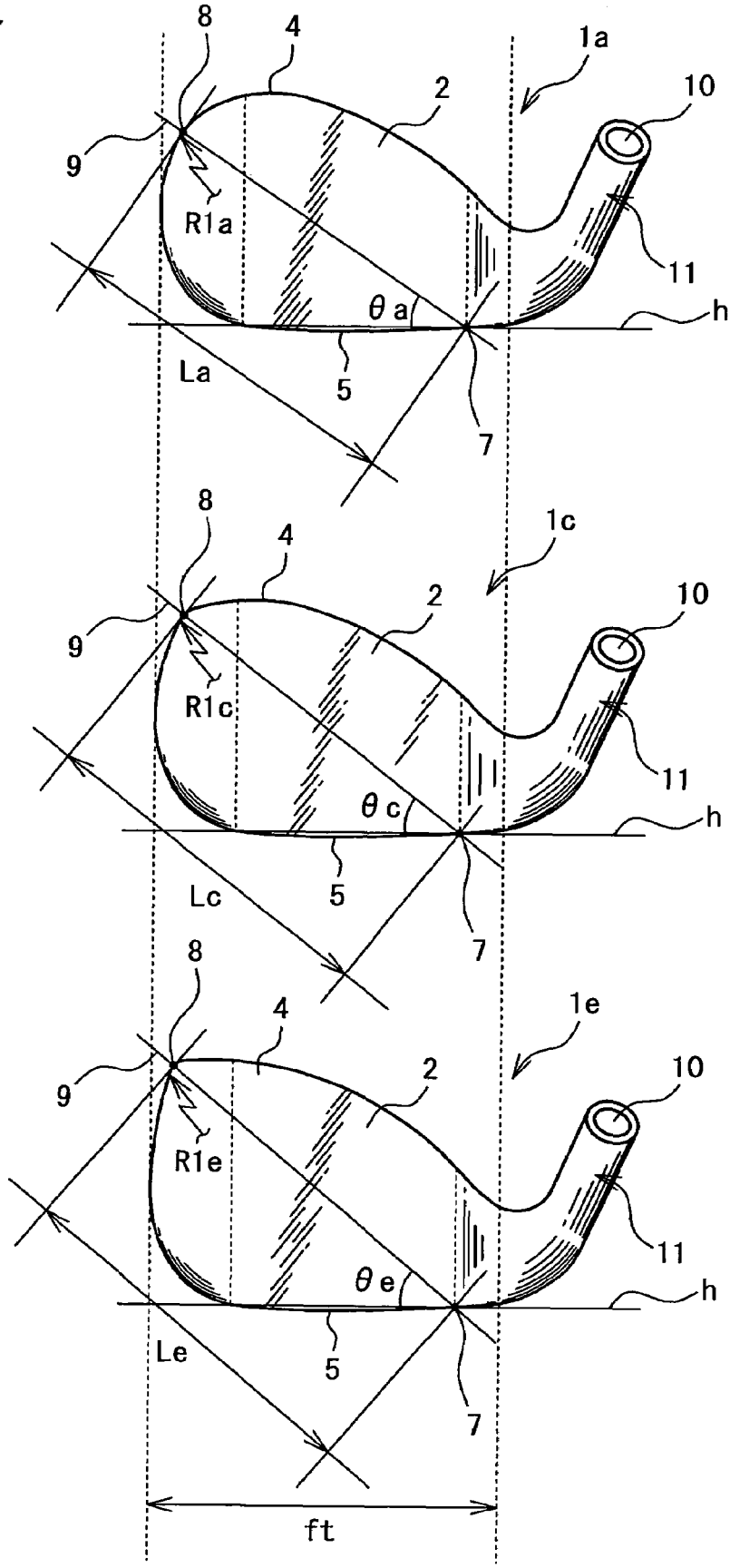
FIG. 5 shows the projected plans of three out of the five types of iron golf-club heads of FIG. 2 in vertical alignment.

The length L of the maximum transversal 9 on the face 2, the toe curvature radius R1 and the angle θ of the maximum transversal 9 are correlated with one another. The correlation is illustrated in FIG. 2 and FIG. 5. FIG. 2 shows projected plans of five types of iron heads 1*a* to 1*e* in overlapped relation, the heads each having a different shape at an upper part of a toe area. FIG. 5 shows the projected plans of three heads 1*a*, 1*c*, 1*e* out of the five iron heads 1*a* to 1*e* in vertical alignment.

The specifications of the head 1*a* include: an angle of the maximum transversal indicated at θa; a toe curvature radius indicated at R1*a*; and a length of the maximum transversal 9 on the face 2 indicated at La. The specifications of the head 1*b* include: an angle of the maximum transversal indicated at θb; a toe curvature radius indicated at R1*b*; and a length of the maximum transversal 9 on the face 2 indicated at Lb. Likewise, the specifications of the head 1*c* include (θc, R1*c*, Lc); the specifications of the head 1*d* including (θd, R1*d*, Ld); and the specifications of the head 1*e* including (θe, R1*e*, Le). The numerical relation of the angles θa to θe of the maximum transversals is θa<θb<θc<θd<θe. The numerical relation of the toe curvature radii R1*a* to R1*e* is R1*a*>R1*b*>R1*c*>R1*d*>R1*e*. The numerical relation of the lengths La to Le is La<Lb<Lc<Ld<Le. Thus, the heads 1*a* to 1*e* are configured such that with the decrease of the toe curvature radius R1, the angle θ of the maximum transversal as well as the length L are correspondingly increased.

Under a condition that a face length ft is fixed, as shown in FIG. 5, the length L of the maximum transversal 9 on the face 2 is increased in the order of the head 1*a*, the head 1*c* and the head 1*e*. That is, La<Lc<Le. This is the result of progressively increasing the angle θ of the maximum transversal in the order of the head 1*a*, the head 1*c* and the head 1*e* (θa<θc<θe) and of progressively decreasing the toe curvature radius R1 (Ra1>R1*c*>R1*e*).

In this manner, the toe curvature radius R1, the maximum transversal angle θ, and the length L are correlated. Therefore, the maximum transversal 9 on the face 2 may be set to a relatively long length L with respect to the face length ft by limiting the toe curvature radius R1 and the maximum transversal angle θ to the predetermined ranges.

A length Lf of the face line (where plural face lines 3 exist, a length of the longest one of these face lines) may preferably at least 48 mm, or more preferably at least 50 mm. If the length Lf of the face line is too short, the possibility of a portion free from the face lines impacting the ball is increased so that it becomes more difficult to impart a proper amount of backspin to the ball. The length Lf of the face line may preferably be 55 mm or less, and more preferably 53 mm or less. If the face line 3 is too long, an area including the face lines is too large relative to the size of the face, resulting in impaired design integrity. In addition, such a head is difficult to address because a sweet area is less recognizable.

The toe curvature radius R1 is defined to be at least 10 mm, as mentioned supra. However, it is more preferred to define the toe curvature radius R1 to be 12 mm or more. If the toe curvature radius R1 is too small, the upper part of the toe area has an excessively angular shape so that the toe may appear incongruous to the player at address, although it is easier to increase the length L of the maximum transversal 9 on the face 2. In addition, the toe curvature radius R1 is defined to be 22 mm or less. However, it is preferred to define the toe curvature radius R1 to be 19 mm or less, more preferably 16 mm or less, and even more preferably 15 mm or less. An excessively great toe curvature radius R1 results in a tendency to decrease the length L of the maximum transversal 9 on the face 2 and also in an excessively small angle θ of the maximum transversal.

The angle θ of the maximum transversal is defined to be at least 39°, as mentioned supra. However, the angle of the maximum transversal may preferably be at least 42°, more preferably at least 44°, and even more preferably at least 45°. If the angle θ of the maximum transversal is too small, the length L of the maximum transversal 9 on the face 2 tends to be decreased. In addition, the angle θ of the maximum transversal is defined to be 50° or less, but may preferably be 48° or less. If the angle θ of the maximum transversal is too great, an upper vertex (on a top side) of the face contour 4 is located too close to the heel side so that the shape of the head may appear incongruous to the player at address.

A material for the iron head 1 is not particularly limited. Examples of a usable material include: soft iron; stainless steel; titanium; titanium alloys; aluminum alloys; magnesium alloys; copper alloys and the like. Alternatively, plural kinds of metals may be used in combination. For instance, a face portion may be formed from a titanium alloy or stainless steel whereas a body portion of the head other than the face portion may be formed from a stainless steel or the like.

In order to confirm the effects of the invention, 13 types of iron golf clubs in total were fabricated and evaluated. The iron golf clubs included 9 types of clubs of Examples 1 to 9 and 4 types of clubs of Comparative Examples 1 to 4. The iron golf clubs of all the examples and of all the comparative examples (hereinafter, also referred to as "all the examples") had a lie angle of 64°, a bounce angle of 8°, a real loft angle of 58° and a club length of 35 inches. All the examples employed a common shaft and grip. The specifications and evaluation results of the individual examples are listed in Table 1.

TABLE 1

| | MTA θ | LECR R2 (mm) | TCR R1 (mm) | Ease of address | Lateral RY | RY in flight direction |
|---|---|---|---|---|---|---|
| Ex. 1 | 45 | 90 | 15 | 7.0 | 2.7 | 4.9 |
| Ex. 2 | 45 | 110 | 15 | 8.5 | 1.8 | 4.0 |
| Ex. 3 | 45 | 125 | 15 | 8.2 | 1.8 | 4.3 |
| Ex. 4 | 45 | 140 | 15 | 7.8 | 2.4 | 4.4 |
| Ex. 5 | 45 | 170 | 15 | 6.5 | 3.0 | 5.0 |
| Ex. 6 | 45 | 125 | 10 | 7.2 | 1.7 | 4.3 |
| Ex. 7 | 45 | 125 | 22 | 7.5 | 2.6 | 4.8 |
| Ex. 8 | 39 | 125 | 15 | 7.2 | 2.7 | 4.7 |
| Ex. 9 | 50 | 125 | 15 | 7.4 | 2.8 | 4.7 |
| CEx. 1 | 45 | 125 | 5 | 6.0 | 3.4 | 5.8 |
| CEx. 2 | 45 | 125 | 30 | 6.2 | 3.0 | 5.5 |
| CEx. 3 | 36 | 125 | 15 | 5.9 | 3.5 | 5.6 |
| CEx. 4 | 60 | 125 | 15 | 6.1 | 3.2 | 5.4 |

Note:
MTA means Maximum Transversal Angle;
LECR means Leading-Edge Curvature Radius;
TCR means Toe Curvature Radius;
RY means Remaining Yardage.

The evaluation test was conducted by 20 testers handicapped at 0 to 10.

The term "ease of address" in Table 1 means the degree of ease of addressing the ball with the face open (ease of assuming the address posture). The ease of address is represented by the average of evaluation points graded by 20 testers on a scale from 0 to 10. The higher point indicates the higher degree of ease of assuming the posture with the face open or the less awkwardness.

The terms "lateral remaining yardage" and "remaining yardage in flight direction" are each represented by an average value which was determined as follows. Each of 20 testers hit ten 40-yard approach shots with the face open and a distance between a pin as a target and a stationary point for each shot was measured. Then, the average of the distances between the pin and the stationary points for 200 shots in total (10 shots hit by each of the 20 testers) was calculated. The "lateral remaining yardage" means a lateral distance (yard) between the pin and the stationary point (in a direction perpendicular to a line interconnecting a launch point and the pin and also parallel to the ground). The "remaining yardage in flight direction" means a distance between the pin and the stationary point with respect to a flight direction (a direction along the line interconnecting the launch point and the pin). In respect of both the lateral remaining yardage and the remaining yardage in flight direction, therefore, the smaller value indicates the closer approach of the ball to the pin or the better result.

As seen in Table 1, all the examples achieved the higher evaluations than all the comparative examples in terms of the ease of address. Considering all the remaining yardages with respect to the lateral direction and the flight direction, all the examples achieved smaller remaining yardages than all the comparative examples.

What is claimed is:

1. An iron golf-club head having (1) a loft angle of 45° or more, (2) a leading edge and (3) a face bounded by a face contour and having at least one face line inclined at an angle of 2° or less relative to a horizontal direction as determined in a reference position, where the head is placed on a horizontal plane at a predetermined lie angle and the predetermined loft angle, wherein in a projection of the face on a projection plane that includes the sweet spot on the face and is normal to a line that (1) extends through the center of gravity of the head and (2) is normal to the face, a maximum transversal, defined as the longest straight line cutting across the face contour and extending through (1) an intersection of the leading edge and a straight line drawn from a heel-side end point of the at least one face line in a predetermined direction along the projection plane and (2) an upper toe-side of the face contour, forms an angle in a range of 39° to 50° with an intersection defined by the projection plane and the horizontal plane, and wherein the face contour has a radius of curvature in the range of 10 mm to 22 mm in the vicinity of a toe-side intersection of the face contour and the maximum transversal.

2. An iron golf-club head according to claim 1, wherein the leading edge has a radius of curvature in the range of 110 mm to 140 mm, in the projection plane.

3. An iron golf club comprising an iron golf-club head and a shaft attached to the club head, wherein the iron golf-club head has (1) a loft angle of 45° or more, (2) a leading edge and (3) a face bounded by a face contour and having at least one face line inclined at an angle of 2° or less relative to a horizontal direction as determined in a reference position, where the head is placed on a horizontal plane at a predetermined lie angle and the predetermined loft angle, and wherein:

in a projection of the face on a projection plane that includes the sweet spot on the face and is normal to a line that (1) extends through the center of gravity of the head and (2) is normal to the face, a maximum transversal, defined as the longest straight line cutting across the face contour and extending through (1) an intersection of the leading edge and a straight line drawn from a heel-side end point of the at least one face line in a predetermined direction along the projection plane and (2) an upper toe-side of the face contour, forms an angle in a range of 39° to 50° with an intersection defined by the projection plane and the horizontal plane, and wherein the face contour has a radius of curvature in the range of 10 mm to 22 mm in the vicinity of a toe-side intersection of the face contour and the maximum transversal.

4. An iron golf club according to claim 3, wherein the leading edge has a radius of curvature in the range of 110 mm to 140 mm, in the projection plane.

* * * * *